US009867402B2

(12) United States Patent
West et al.

(10) Patent No.: US 9,867,402 B2
(45) Date of Patent: Jan. 16, 2018

(54) BREAST SUPPORT STRUCTURE

(71) Applicant: Bazooka Jane, Inc., Pittsburgh, PA (US)

(72) Inventors: Laura Catherine West, Pittsburgh, PA (US); Sophia Beth Berman, Pittsburgh, PA (US); Gabriel Goldman, Pittsburgh, PA (US); Britta Kathleen Ulm, Pittsburgh, PA (US); Kayla Louise Geer, Pittsburgh, PA (US); Susan Young Banerjee, Irwin, PA (US)

(73) Assignee: Bazooka Jane, Inc., Pittsburgh, PA (US)

( * ) Notice: Subject to any disclaimer, the term of this patent is extended or adjusted under 35 U.S.C. 154(b) by 141 days.

(21) Appl. No.: 14/963,431

(22) Filed: Dec. 9, 2015

(65) Prior Publication Data

US 2016/0165964 A1 Jun. 16, 2016

Related U.S. Application Data

(60) Provisional application No. 62/090,193, filed on Dec. 10, 2014.

(51) Int. Cl.

| | |
|---|---|
| ***A41C 3/10*** | (2006.01) |
| ***A41C 3/00*** | (2006.01) |
| ***A41C 3/14*** | (2006.01) |

(52) U.S. Cl.

CPC ..... *A41C 3/142* (2013.01); *A41C 3/0007* (2013.01); *A41C 3/10* (2013.01)

(58) Field of Classification Search

CPC .. A41C 3/00; A41C 3/02; A41C 3/122; A41C 3/007; A41C 3/10; A41C 3/142; A41C 3/0057

See application file for complete search history.

(56) References Cited

U.S. PATENT DOCUMENTS

| | | | | |
|---|---|---|---|---|
| 3,446,213 | A | 5/1969 | Goldman | |
| 3,642,009 | A | 2/1972 | Nobbs | |
| 4,235,240 | A | 11/1980 | Cousins | |
| 6,447,365 | B1 * | 9/2002 | Powell | A41C 3/122 450/41 |
| 6,846,219 | B2 | 1/2005 | Moyer | |

(Continued)

FOREIGN PATENT DOCUMENTS

| | | |
|---|---|---|
| BE | 509613 | 3/1952 |
| EP | 2476326 | 7/2012 |

(Continued)

*Primary Examiner* — Gloria Hale

(74) *Attorney, Agent, or Firm* — Fox Rothschild LLP

(57) ABSTRACT

A breast support structure of a garment includes one or more substantially rigid support members. Each substantially rigid support member includes a profile portion having a first end, a second end and a generally curved body that extends between the first end and the second end. The generally curved body includes a top curved surface and a bottom curved surface. Each substantially rigid support member includes a cantilevered portion connected to the top curved surface of the profile portion that projects outward from the profile portion, and one or more structural elements extending across at least a part of the cantilevered portion and at least a part of the profile portion.

18 Claims, 10 Drawing Sheets

(56) References Cited

U.S. PATENT DOCUMENTS

| | | | | |
|---|---|---|---|---|
| 7,234,994 | B2 * | 6/2007 | Fildan | A41C 3/128 450/41 |
| 7,390,239 | B1 | 6/2008 | Huang | |
| 7,407,428 | B2 * | 8/2008 | Fildan | A41C 3/0007 450/41 |
| 8,105,130 | B2 * | 1/2012 | Fildan | A41C 3/142 450/41 |
| 8,747,184 | B2 * | 6/2014 | Liu | A41C 3/0007 450/41 |
| 8,864,549 | B2 | 10/2014 | McKeen | |
| 9,241,514 | B2 * | 1/2016 | Shearer | A41C 3/0057 |
| 9,364,031 | B2 * | 6/2016 | Crompton | A41C 3/0007 |
| 2008/0153389 | A1 | 6/2008 | Nobbs | |
| 2015/0044941 | A1 | 2/2015 | Luxi et al. | |
| 2015/0087203 | A1 | 3/2015 | Turlan-Van Der Hoeven | |
| 2016/0198775 | A1 * | 7/2016 | Crompton | A41C 3/122 450/52 |

FOREIGN PATENT DOCUMENTS

| | | |
|---|---|---|
| FR | 76359 | 8/1961 |
| GB | 2456897 | 5/2009 |

* cited by examiner

BREAST SUPPORT STRUCTURE

CROSS-REFERENCE TO RELATED APPLICATIONS

This application claims priority to U.S. Provisional Patent Application No. 62/090,193, filed on Dec. 10, 2014, the entirety of which is included herein by reference.

BACKGROUND

Current garments designed to support a woman's breasts, such as brassieres (bras), swimsuits, tops with built-in supports and/or the like, utilize a combination of underwires, cups, and bands that can include straps to redirect the load from the weight of the breasts. The main function of such garments is to provide shape and support for the bust.

The underwire is a rigid structure that sits along the lower curvature of the breast where the breast meets the chest in the inframammary crease. The underwire is typically secured in a fabric pocket that connects to both the cup and the band. The cup is shaped to maintain the volume of the breast, and the band is designed to hold the entire bra up on the body. The band is attached along the outside edges of each underwire, which in turn is attached to the left/right edges of the cup and wraps around the side of the body, underneath the arm, and is either connected in back, or connected (around the back) to the other cup.

The underwire, cup, and band combination is used primarily to provide shape and support for the breasts. The straps are secured to the top of the cups and, when tensioned appropriately, help to maintain this shape and support. The shaping that the underwire provides acts to tension the cup to support the breast.

However, underwires and various other structures used by conventional garments to support the breasts, have proven insufficient to support and distribute the load of the breast and often cause immediate and/or long-term discomfort or pain.

SUMMARY

This disclosure is not limited to the particular systems, methodologies or protocols described, as these may vary. The terminology used in this description is for the purpose of describing the particular versions or embodiments only, and is not intended to limit the scope.

As used in this document, the singular forms "a," "an," and "the" include plural reference unless the context clearly dictates otherwise. Unless defined otherwise, all technical and scientific terms used herein have the same meanings as commonly understood by one of ordinary skill in the art. All publications mentioned in this document are incorporated by reference. All sizes recited in this document are by way of example only, and the invention is not limited to structures having the specific sizes or dimension recited below. As used herein, the term "comprising" means "including, but not limited to." The phrase "about" or "approximately" means within twenty percent (20%) of the numerical amount cited.

In an embodiment, a breast support structure of a garment includes one or more substantially rigid support members. Each substantially rigid support member includes a profile portion having a first end, a second end and a generally curved body that extends between the first end and the second end. The generally curved body includes a top curved surface and a bottom curved surface. Each substantially rigid support member includes a cantilevered portion connected to the top curved surface of the profile portion that projects outward from the profile portion, and one or more structural elements extending across at least a part of the cantilevered portion and at least a part of the profile portion.

The cantilevered portion is configured to extend under at least a portion of a wearer's breast. The first end of the profile portion is configured to be positioned proximate a first side of a wearer's breast, and the second end of the profile portion is configured to be positioned proximate a second side of the wearer's breast.

Optionally, the cantilevered portion is formed integral with the profile portion.

In various embodiments, the structural elements extend from an inner edge of the cantilevered portion toward an outer of the cantilevered portion.

Optionally, the breast support structure includes one or more mechanical hinges. The mechanical hinges may be positioned at an intersection of the cantilevered portion and the profile portion. One or more of the mechanical hinges may include an aperture. Optionally, one or more of the mechanical hinges may include one or more grooves that extend along a portion of the cantilevered portion and along a portion of the profile portion.

In an embodiment, one or more substantially rigid support members each has a hardness value of between about 50 to 130 on the Rockwell scale (about 50 R to about 130 R). A substantially rigid support member may be formed from a polymer or a polymer having one or more additives.

Optionally, a breast support structure may include a comfort layer attached to an inner surface of the profile portion such that the comfort layer is configured to be positioned between a wearer and the one or more substantially rigid support members. The comfort layer may be fabricated from one or more of one or more polymers, a foam, a gel, or rubber. In an embodiment, the comfort layer may be overmolded over the one or more substantially rigid support members.

In an embodiment, a garment for supporting a wearer's breasts includes a first breast cup having a first substantially rigid support member in a bottom portion of the first breast cup, and a second breast cup having a second substantially rigid support member in a bottom portion of the second breast cup. The first substantially rigid support member, the second substantially rigid support member or both the first substantially rigid support member and the second substantially rigid support member include a profile portion, a cantilevered portion, one or more structural elements, and a comfort layer. The profile portion has a first end, a second end and a generally curved body that extends between the first end and the second end. The generally curved body includes a top curved surface and a bottom curved surface. The cantilevered portion is connected to the top curved surface of the profile portion, and projects outward from the profile portion. The one or more structural elements extend across at least a part of the cantilevered portion and at least a part of the profile portion. The comfort layer is attached to an inner surface of the profile portion.

The first breast cup may include a front portion and a back portion, where the first substantially rigid support member is positioned between the front portion of the first breast cup and the back portion of the first breast cup. Similarly, the second breast cup may include a front portion and a back portion, where the second substantially rigid support member is positioned between the front portion of the second breast cup and the back portion of the second breast cup.

In an embodiment, the first breast cup is overmolded around the first substantially rigid support member, and the second breast cup is overmolded around the second substantially rigid support member. Optionally, the garment may be a brassiere.

Optionally, the first substantially rigid support member, the second substantially rigid support member or both the first substantially rigid support member and the second substantially rigid support member may include one or more mechanical hinges. The hinges may be positioned at an intersection of the cantilevered portion and the profile portion of the first substantially rigid support member, the second substantially rigid support member or both the first substantially rigid support member and the second substantially rigid support member. The mechanical hinges may include an aperture and/or one or more grooves.

DETAILED DESCRIPTION

The following terms shall have, for purposes of this application, the respective meanings set forth below:

A "comfort layer" refers to a semi-rigid structure that acts as an interface between a wearer and a substantially rigid support member.

A "hybrid support structure" refers to a support structure having a comfort layer.

An "inframammary crease" refers to a natural boundary of a breast from below where a breast and chest meet.

A "substantially rigid support member" refers to a structure having a cantilevered portion connected to a profile portion. The phrase "substantially rigid" refers the rigidity as compared to a traditional metal underwire. As described in this disclosure, a substantially rigid support member has less rigidity than a traditional garment underwire.

A "support structure" refers to at least two substantially rigid support members.

Figure 1:
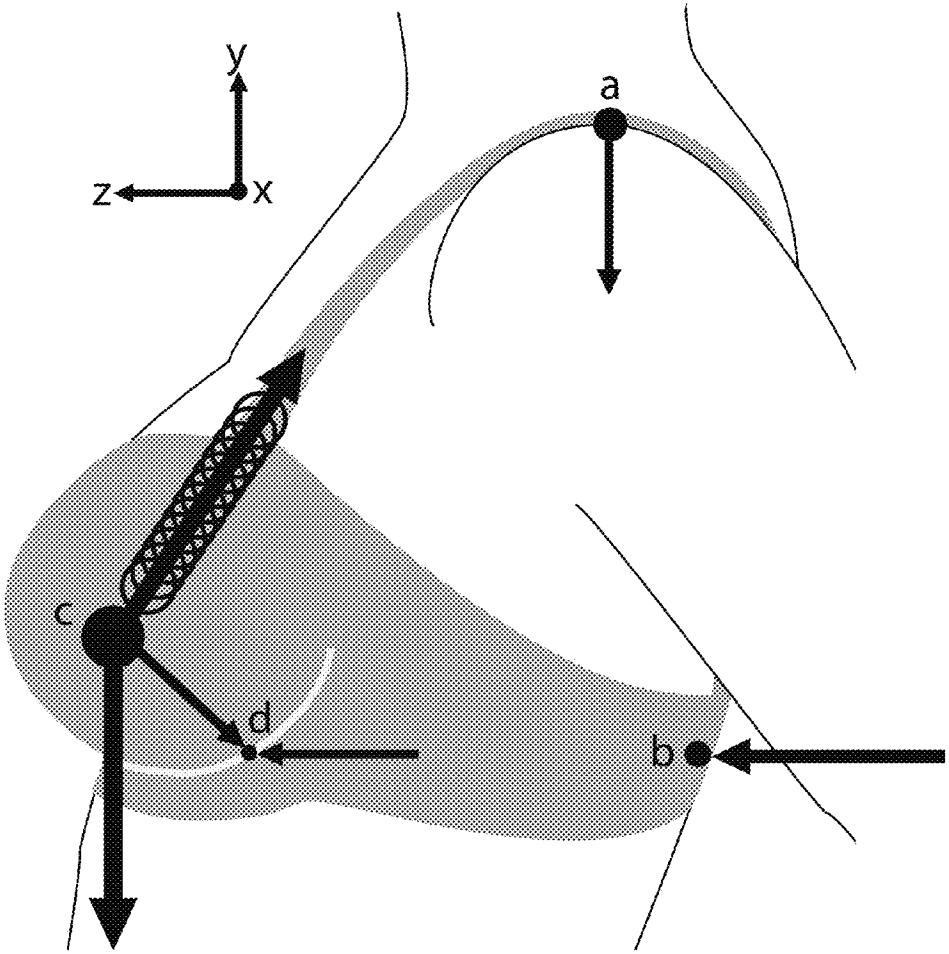
FIG. 1 illustrates example relative forces acting upon bodies in this disclosure according to an embodiment.

Forces acting upon a breast can be described mathematically by Hooke's Law, where $F=-kx$. Hooke's Law states that the restorative force required to extend or compress a spring by some distance is proportional to that distance. As an example, a system may encompass the breast, bra strap, shoulder contact point, and torso contact points. The spring constant (k) is embodied in the elastic properties of the bra strap material. Breast movement is assumed to be linear in the x, y, and z planes. FIG. 1 illustrates example relative forces acting upon the bodies in this system through the shoulder contact point (a), the torso contact point (b), the breast (c), and the underwire contact point (d).

In an embodiment, a bra may provide a force through the straps (in the y and z planes) and the band (in the x and z planes) that is equivalent to the weight of the breast and that minimizes breast movement. Therefore, an equivalent force acting through the bra strap in opposition to the force of the breast is desired. This force is then transferred through the strap onto the user's shoulders. Forces acting on the breast from the bra band are transferred to the torso along the underwire of the bra.

The use of underwires in conventional bras to support the breasts have proven insufficient for supporting and distributing the breast load and often cause immediate and/or long-term discomfort or pain to user. The majority of discomfort a wearer experiences is often due to unsupported breast movement. Two main areas of discomfort a wearer experiences are on the shoulders and on the sides of the body. In general, when breasts are poorly supported, the resulting bra displacement can create friction and discomfort to the sides of the body. Additional friction between the fabric pocket containing the underwire and underwire allows the underwire to be free or semi-free and causes discomfort to the flesh (typically under the arm and at the gore/sternum areas). One noted medical condition caused by improperly supported breasts is thoracic outlet syndrome (TOS). TOS occurs when the amount of pressure on the shoulder area compresses nerves and blood vessels that exit to the upper arms (as shown, for example, in FIG. 1, point a) causing numbness or tingling in the hands/arm, and pain in the neck, shoulders and/or hands.

As breast size increases, so does the force loading on the wearer. Breast loads vary from 0.25 pound per breast for smaller cup sizes to six pounds or more per breast for larger cup sizes. Existing bras increase strap and band width in order to distribute the force applied on the wearer's shoulders. Existing bras still place the majority of the breast load on the shoulders through the straps. The band provides stability and support for the wearer by compressing around the torso, most notably in strapless bra applications.

Various embodiments of this disclosure describe replacing an underwire of a garment, such as a bra, a swimsuit, or other garments, with a hybrid support structure that supports the breasts from below. A hybrid support structure, as described in more detail below, may minimize the effects of breast and strap displacement and increase the surface area of the garment that is in contact with the torso below the breasts. This redistribution of load away from the shoulders and through larger contact areas may relieve the pain and discomfort associated with larger, heavy breasts. A hybrid support structure may minimize band displacement and provide more comfort to a wearer.

Figure 2:
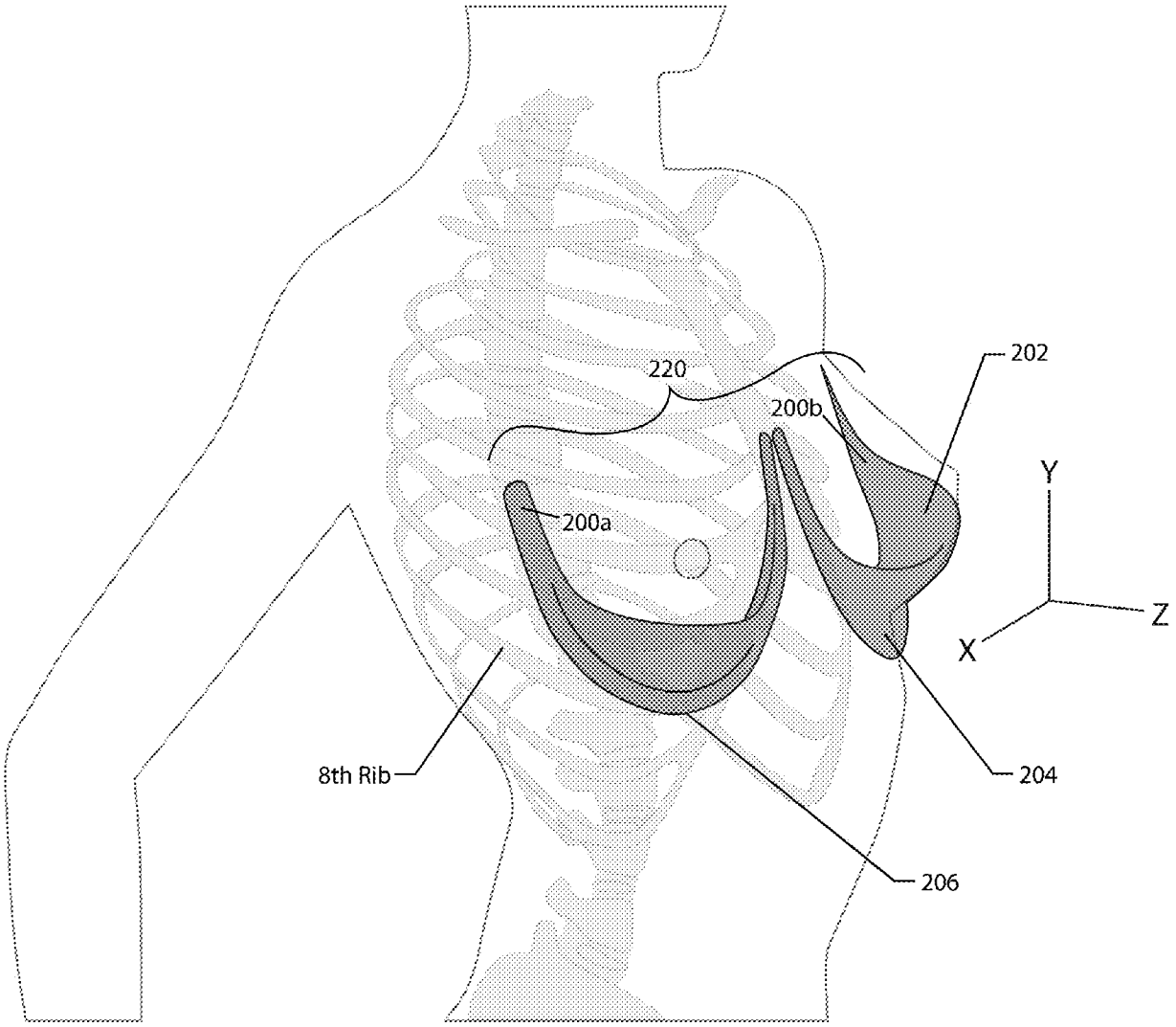
FIG. 2 illustrates an example support structure according to an embodiment.

FIG. 2 illustrates an example support structure 220 according to an embodiment. As illustrated by FIG. 2, a support structure 220 may include two substantially rigid support members 200*a*, 200*b*. A substantially rigid support member 200*a*, 200*b* may be adapted and configured to span from the outside of a wearer's breast to the inside (gore/sternum area) of the wearer's breast and to extend along the inframammary crease of the breast and project or extend outward from the chest. A support structure 220 may include a substantially rigid support member 200*a* for a wearer's right breast, and a substantially rigid support member 200*b* for a wearer's left breast.

A substantially rigid support member 200*a*, 200*b* may include a cantilevered portion 202 and a profile portion 204. A cantilevered portion 202 may be adapted and configured to extend across a wearer's ribcage under the wearer's breasts, and to bear a load as applied by the wearer's breasts. When incorporated into a garment worn by a wearer, a wearer's breasts may rest on and be supported by the cantilevered portion 202.

A cantilevered portion 202 may extend outward from a wearer. The amount of the cantilever extension of a cantilevered portion 202 in the z-plane along an inframammary crease may vary based on the size and weight of breast being supported. A cantilevered portion 202 may extend outward from a wearer's chest about 1 inch for smaller sized breasts to about 6 inches for larger sized breasts. Additional and/or alternate lengths may be used within the scope of this disclosure.

In an embodiment, a profile portion 204 may have a generally curved or U-shape body. The profile portion may have a first end 236 that may be positioned proximate a top portion of one side of a wearer's breast, and a second end 238 that may be positioned proximate a top portion of the opposite side of the wearer's breast. As such, a profile portion may sit against a wearer's chest, and its body may extend along and below a wearer's breast. A profile portion 204 may have an inner surface 234 and an outer surface 240. An inner surface of a profile portion may be that which faces inward on a wearer. An outer surface 240 of a profile portion may face outward from a wearer. A profile portion 204 may have a top curved surface 244 and a bottom curved surface 246.

Figure 3A:
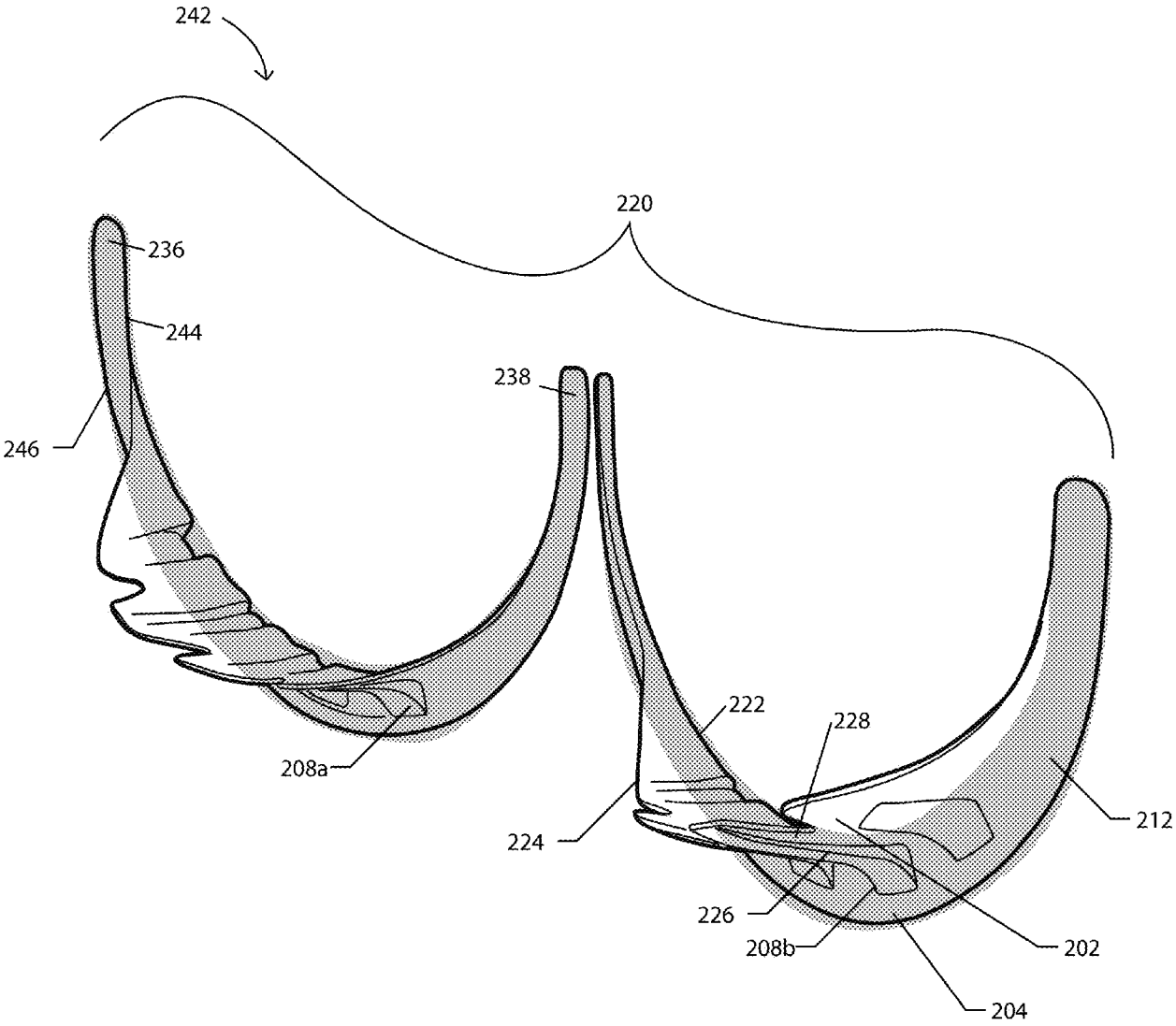
FIG. 3A illustrates a perspective view of an example hybrid support system having a comfort layer according to an embodiment.

In various embodiments, a profile portion 204 may be connected to a cantilevered portion 202. For example, a profile portion 204 may be formed integral with a cantilevered portion 202. As illustrated in FIG. 3A, a cantilevered portion 202 may be connected to and extend outward from the top curved surface 244 of the profile portion 204. A cantilevered portion 202 and a profile portion 204 may be generally perpendicular to one another. In some embodiments, a cantilevered portion 202 may have a curvature to conform to a curvature of a breast thus making the positioning of the cantilevered portion 202 and the profile portion 204 generally perpendicular.

A profile portion 204 may be adapted and configured to transfer at least a portion of a load applied by the wearer's breasts to the cantilevered portion 202 to a region of the wearer's chest below the wearer's breasts. As such, a profile portion 204 may distribute the load of a wearer's breasts on a cantilevered portion to a region of the wearer's chest below the wearer's breasts such as, for example, a wearer's core.

In an embodiment, the design of a substantially rigid support member 200*a*, 200*b* may be based, at least in part, on the weight of the breast, the volume or protrusion of the breast from the chest, the amount of contact along the horizontal curvature of the chest by the support form, the desired amount of pressure the user should feel during normal use, and/or the amount of movement the breasts are expected to experience during normal use. A substantially rigid support member 200*a*, 200*b* may counteract the moment load caused by the cantilevered weight of the breast.

In an embodiment, the lowest point 206 of the curvature of the base of a substantially rigid support member 200*a*, 200*b* may extend down to a wearer's $5^{th}$, $6^{th}$, $7^{th}$, $8^{th}$, or $9^{th}$ rib, with a height ranging from about ⅛ inch to about 4 inches. This height may begin at the inframammary crease and may extend down to the lowest point of the substantially rigid support member 200*a*, 200*b*.

In various embodiments, a substantially rigid support member 200*a*, 200*b* may be scaled in size to accommodate different sized breasts. A scaling system may be based on a percentage increase or decrease from a reference size of a substantially rigid support member. For instance, a scaling system may use a value (integer or non-integer value) between 0%-50% to scale the size of a substantially rigid support member from a reference size. For example, a substantially rigid support member 200*a*, 200*b* may be scaled 0-50% smaller or 0-50% larger than a reference size. The scaling system may or may not be applied equally throughout the entire substantially rigid support member and/or across the range of possible sizes.

Figure 3B:
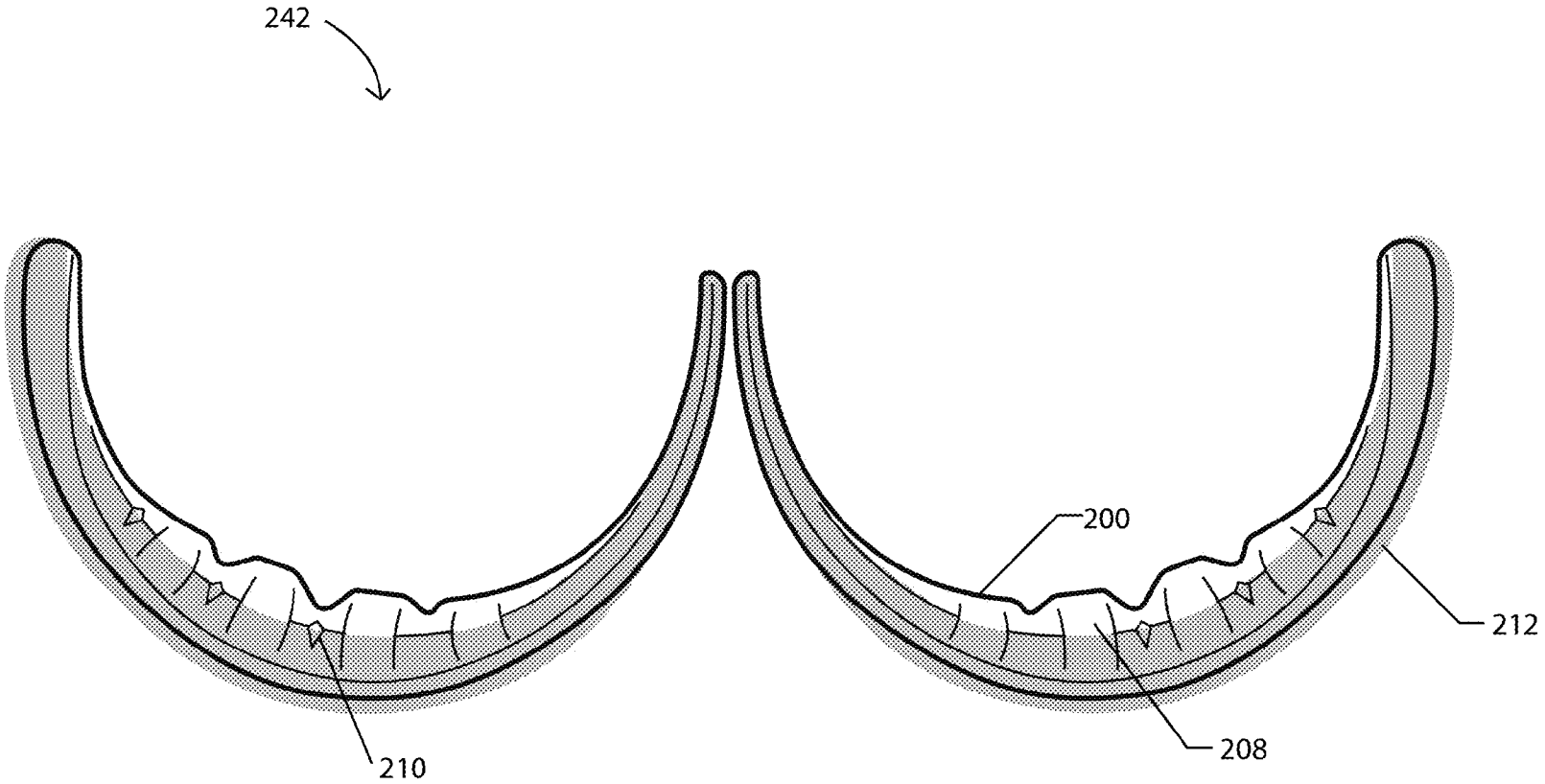
FIG. 3B illustrates a front view of an example hybrid support structure according to an embodiment.
Figure 4:
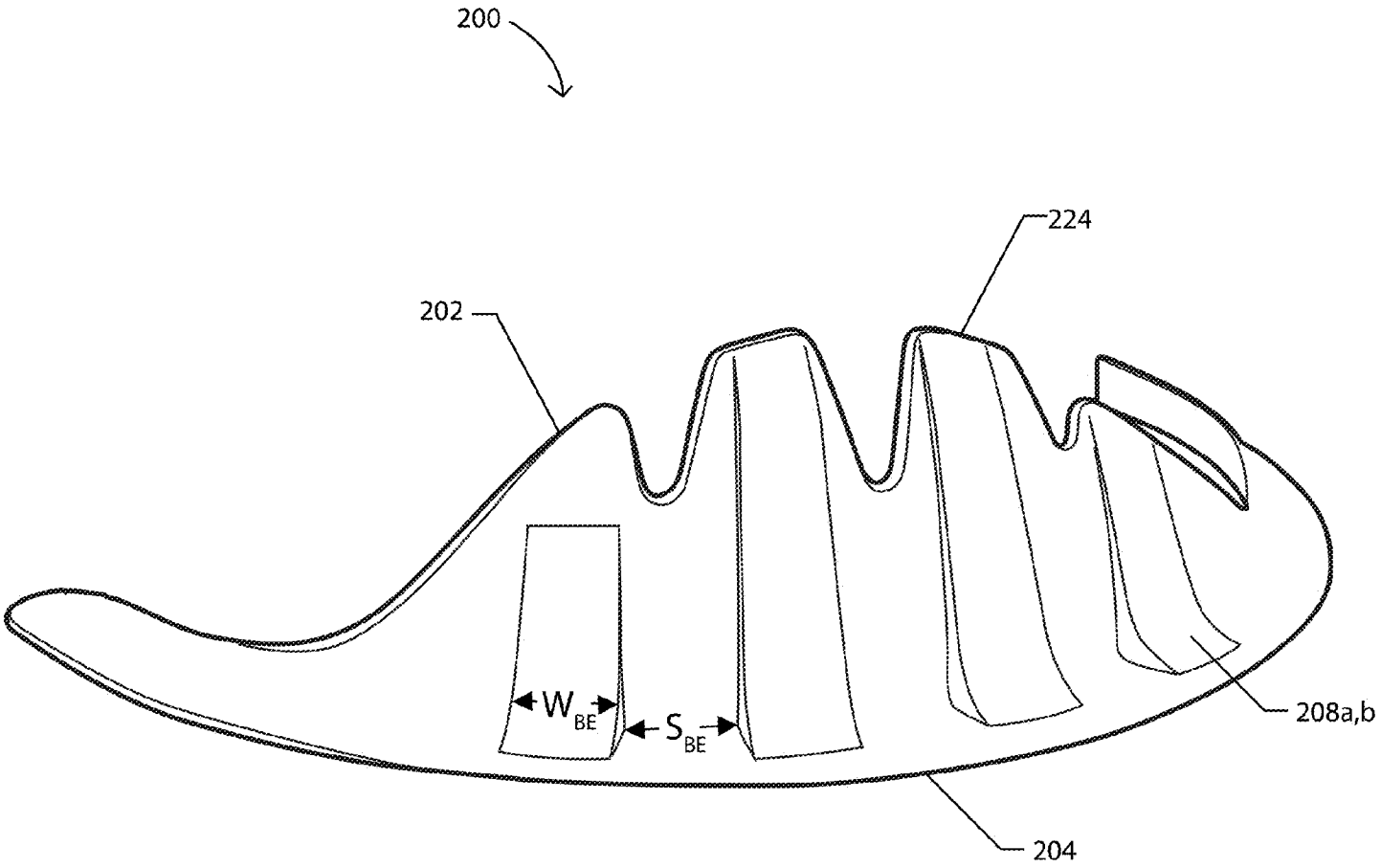
FIG. 4 illustrates an example of a substantially rigid support member according to an embodiment.

In certain embodiments, a substantially rigid support member 200*a*, 200*b* may include one or more structural elements 208*a*, 208*b*, as illustrated by FIGS. 3A, 3B, and 4. As shown by FIG. 3A, a structural element 208*a*, 208*b* may extend from an inner edge 222 of a cantilevered portion 202 toward an outer edge 224 of a cantilevered portion 202. In other words, a structural element 208*a*, 208*b* may extend from a wearer's inframammary crease toward the front of the wearer's breast.

A structural element 208*a*, 208*b* may be adapted and configured to support the cantilevered portion 202 and/or transfer load to the profile portion 204. Exemplary structural elements 208*a*, 208*b* may include, without limitations, corbels, trusses, ribs, bridges, and buttresses. The structural elements 208*a*, 208*b* may be spaced at uniform or variable intervals from one another.

As illustrated by FIG. 4, a structural element 208*a*, 208*b* may have a maximum width, $W_{BE}$, of approximately 0 inches to approximately 12 inches. The space $S_{BE}$ between one or more pairs of structural elements 208*a*, 208*b* may have a width of approximately 0 inches to approximately 10 inches. In various embodiments, a substantially rigid support member 200*a*, 200*b* may include about 0 to about 25 structural elements 208*a*, 208*b* on one or more substantially rigid support members 200*a*, 200*b*. In certain embodiments, each substantially rigid support member 200*a*, 200*b* of a hybrid support structure 220 may include the same number of structural elements 208*a*, 208*b*. In other embodiments, one substantially rigid member 200*a*, 200*b* of a support structure may include a different number of structural elements 208*a*, 208*b* from another substantially rigid member 200*a*, 200*b* of the support structure 220.

In an embodiment, a structural element 208*a*, 208*b* may be solid or may be at least partially hollowed as shown in FIG. 3A to provide flexibility and/or ventilation, absorb forces from the breast, and/or to conform to the breasts and/or the chest.

In an embodiment, a front portion 226 of structural elements 208*a*, 208*b* may follow the external curvature of a support structure facing away from the body whereas a rear portion 228 of the structural elements may follow the curvature of either the breast or chest, depending on where the location of the structural elements meets the body. In some embodiments, the thickness of the structural elements 208*a*, 208*b* (i.e., the distance by which the structural elements sits proud of the adjacent substantially rigid support member 200*a*, 200*b*) may be defined with respect to the thickness of the adjacent substantially rigid support member. For example, the structural element thickness may be less than either an average thickness of the adjacent substantially rigid support member 200*a*, 200*b* or can have thickness less than the local thickness of the adjacent substantially rigid support member.

In certain embodiments, the length of structural elements 208*a*, 208*b* may vary across structural elements. For instance, FIG. 4 illustrates example structural elements 208*a*, 208*b* having varying lengths. This may result in an outer edge 224 of the cantilevered portion having an uneven profile as illustrated by FIG. 4.

Figure 5:
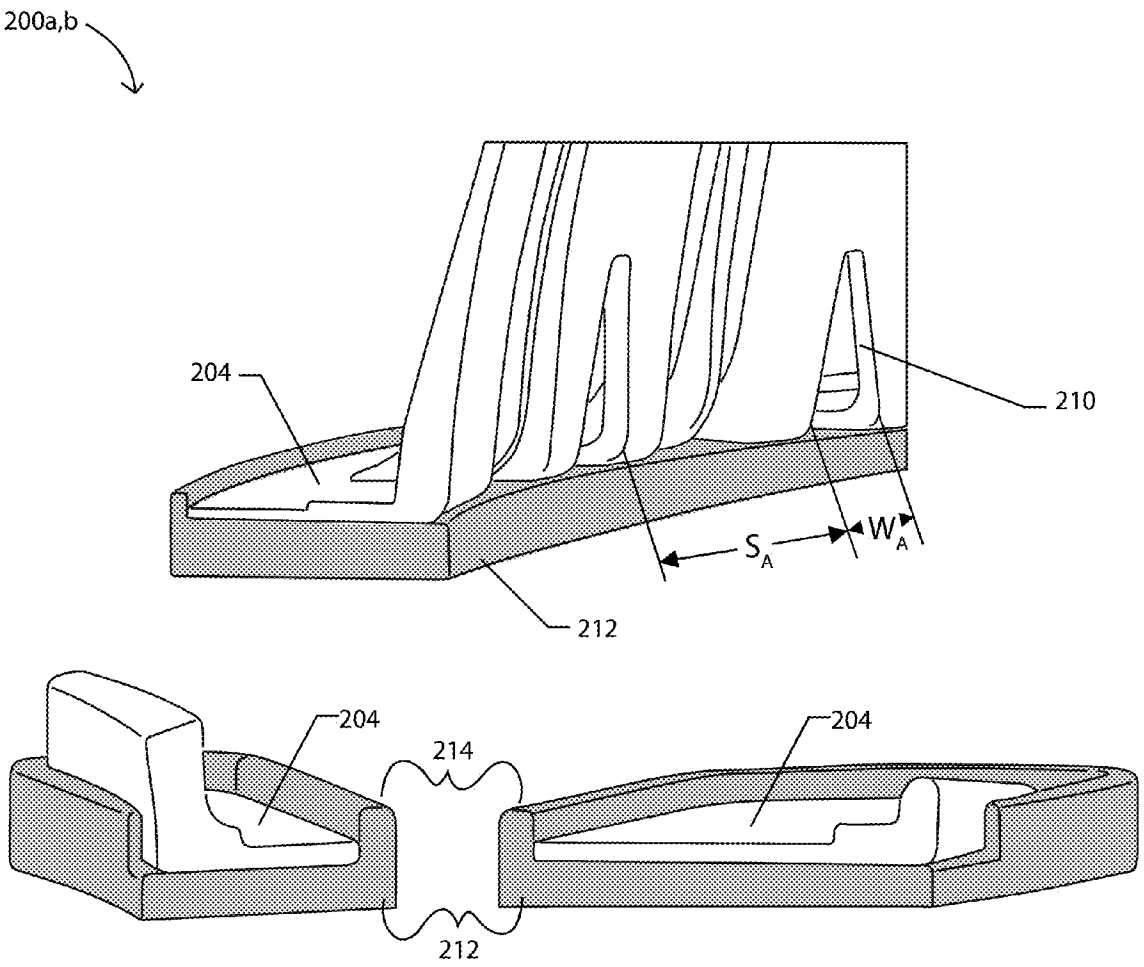
FIG. 5 illustrates various partial cross-sectional views depicting an example interface between substantially rigid support members and a comfort layer according to an embodiment.
Figure 6:
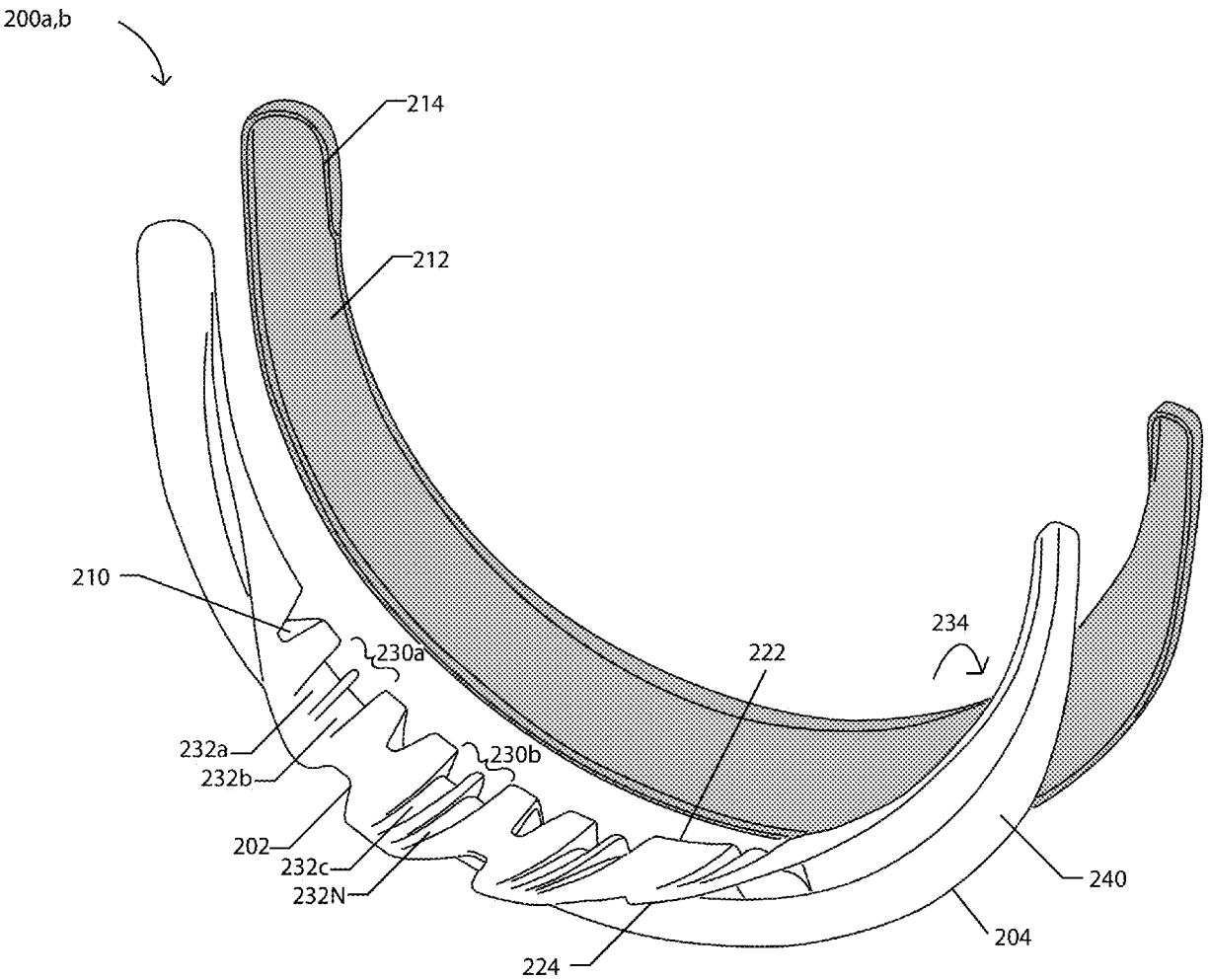
FIG. 6 provides an exploded perspective view of example substantially rigid support members and a comfort layer according to an embodiment of the invention.
Figure 7:
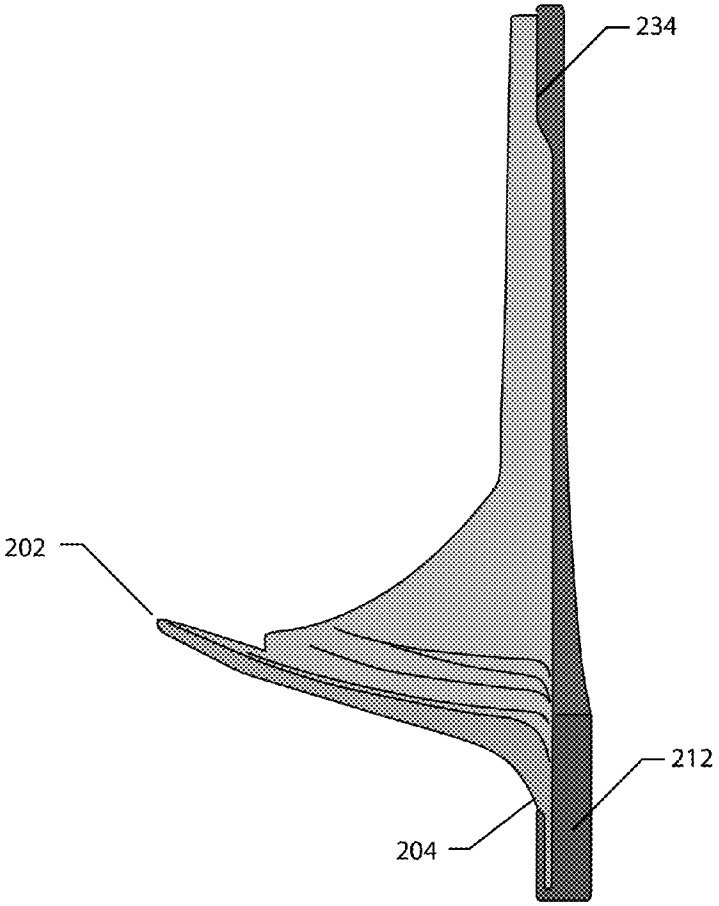
FIG. 7 depicts a side view of an example substantially rigid support member with a comfort layer depicted along the rear, chest-facing surface of the substantially rigid support member according to an embodiment of the invention.

In various embodiments, a substantially rigid support member 200*a*, 200*b* may include one or more mechanical hinges 210, 230*a* 230*b*. A mechanical hinge 210, 230*a*, 230*b* may allow for mechanical flexing by a substantially rigid support member 200*a*, 200*b*, for example, to bend and curve around and underneath a wearer's inframammary crease. A mechanical hinge may be an aperture 210 as illustrated by FIGS. 3B, 5 and 6. In an embodiment, a mechanical hinge 230*a*, 230*b* may be grooves 232*a*-N of a structural element as illustrated in FIG. 6. Additional and/or alternate mechanical hinges may be used within the scope of this disclosure.

In certain embodiments, one or more mechanical hinges 210, 230*a*, 230*b* may be located on a substantially rigid support member 200*a*, 200*b* at the intersection of the cantilevered portion 202 and the profile portion 204 and may span at least a portion of the distance between the surfaces 202 and 204. Apertures 210 may have a variety of shapes such as circular, rectangular, rhomboid, kite, geometric, organic, and the like. In an embodiment, apertures 210 may be spaced in between structural elements 208*a*, 208*b*, on the outside of structural elements, or a combination thereof. Apertures 210 may have a width $W_A$ at the widest point of about 0 inches to about 4.0 inches. A substantially rigid support member 200*a*, 200*b* may include between about 0 to about 25 apertures 210.

In various embodiments, as illustrated by FIG. 6, a mechanical hinge 230*a*, 230*b* may be implemented as one or more grooves 232*a*-N in the substantially rigid support member 200*a*, 200*b*. A groove 232*a*-N may refer to an indentation or thinned out portion of a substantially rigid support member 200*a*, 200*b*. For instance, a mechanical hinge 230*a*, 230*b* may include one or more grooves 232*a*-N in the cantilevered portion 202 that extends along at least a portion of the cantilevered portion. FIG. 6 shows example mechanical hinges 230*a*, 230*b* having one or more grooves 232*a*-N that extend along a cantilever surface 202 from an inner edge 222 of the cantilevered portion toward an outer edge 224 of the cantilevered portion. The inner edge 222 of the cantilevered portion 202 may be nearest to a wearer's chest, while the outer edge 224 of the cantilevered portion may be a portion further from the wearer's chest.

Grooves 232*a*-N may have varying widths, depths and lengths depending on the size of the substantially rigid support member 200*a*, 200*b* to which it corresponds. For instance, mechanical hinges 230*a*, 230*b* of substantially rigid support members 200*a*, 200*b* adapted for larger sized breasts may have grooves with a larger width, depth and/or length than grooves of hinges of substantially rigid support members adapted for smaller breast sizes. Although FIG. 6 shows mechanical hinges 230*a*, 230*b* having two grooves 232*a*-N, it is understood that a mechanical hinge may have any number of grooves of varying sizes according to this disclosure.

In various embodiments, a substantially rigid support member 200*a*, 200*b* may include a combination of apertures 210 and grooves 232*a*-N. For instance, a substantially rigid support member 200*a*, 200*b* that is adapted for smaller breast sizes may include one or more mechanical hinges 230*a*, 230*b* having one or more grooves 232*a*-N, whereas a substantially rigid support member that is adapted for larger breast sizes may include one or more mechanical hinges 210, 230*a*, 230*b* having one or more grooves 232*a*-N and one or more apertures 210.

A substantially rigid support member 200*a*, 200*b* may include one or more sewing tracks that are particularly receptive to sewing needles in order to facilitate attachment of fabric and/or anchoring of the substantially rigid support members within fabric. For example, the sewing tracks can extend along or adjacent to a border of the cantilevered portion 202 and/or the profile portion 204. The sewing tracks can have a thickness that can be easily be pierced by sewing needles during machine and/or hand stitching. For instance, sewing tracks may have a thickness that is thinner than the thickness of the z-plane surface area of the substantially rigid support member. Additionally or alternatively, the sewing tracks can define a plurality of holes through which stiches can pass.

A substantially rigid support member 200*a*, 200*b* may be economically formed through techniques such as injection molding, vacuum forming, additive manufacturing (also known as 3D printing), and the like. For example, substantially rigid support members 200*a*, 200*b* may be fabricated from various polymers such as plastics. Exemplary plastics include as thermoplastics (e.g., polyolefins, such as polypropylene or thermoplastic polyurethane, or thermosetting plastics such as thermoset polyurethane or thermoset polyester. A substantially rigid support member 200*a*, 200*b* may also be formed from materials with additives, including, without limitation, inorganic and organic materials, using known techniques such as casting, molding, machining, and the like. For instance, a substantially rigid support member 200*a*, 200*b* may be formed using various polymers with a silver additive to serve as an anti-microbial agent.

A substantially rigid support member 200*a*, 200*b* may have Rockwell hardness (R scale) (ASTM D785) between about 50 R and about 130 R. Additional and/or alternate hardness values may be used within the scope of this disclosure.

In another embodiment, a substantially rigid support member 200*a*, 200*b* may have a flexural modulus (ASTM D790) between about 900 MPa and 1300 MPa. For example, a substantially rigid support member 200*a*, 200*b* may have a flexural modulus of about 900 MPa and about 1300 MPa. Additional flexural moduli may be used within the scope of this disclosure.

In still another embodiment, a substantially rigid support member 200*a*, 200*b* may have a Melt Mass-Flow Rate (MFR) (ASTM D1238) between about 10 g/10 min and about 80 g/10 min. For example, a substantially rigid support member 200*a*, 200*b* may be formed from a polymer having an MFR. Additional and/or alternate rates may be used within the scope of this disclosure.

As shown in FIGS. 3A, 3B, 5, 6 and 7, a hybrid support structure 242 may include a support structure 220 and a comfort layer 212. A comfort layer 212 may be a semi-rigid structure that provides comfort to a wearer and acts as a barrier between a wearer and a substantially rigid support member 200*a*, 200*b*. The comfort layer 212 is depicted in FIGS. 3A, 3B, 5, 6 and 7 as a shaded portion. A comfort layer 212 may be coupled to at least an inner surface of a substantially rigid support member 200*a*, 200*b*. For instance, as illustrated by FIG. 6, a comfort layer may be configured to be coupled to an inner surface 234 of a profile portion 204. A comfort layer 212 may have a generally curved shape substantially similar to the shape of a substantially rigid support member 200*a*, 200*b*.

In an embodiment, a comfort layer 212 may be overmolded over a substantially rigid support member 200*a*, 200*b*. A comfort layer 212 may be pour-molded and/or fabric laminated. A comfort layer 212 may be die cut. In an embodiment, a comfort layer 212 may be ultrasonically welded to a substantially rigid support member 200*a*, 200*b*. In another embodiment, a comfort layer 212 may be formed using injection molding.

A comfort layer 212 may be sewn, press or interference fit, or otherwise mechanically attached to a substantially rigid support member 200*a*, 200*b*. Additionally or alternatively, adhesives or other chemicals can be used to facilitate attachment. A comfort layer 212 may extend beyond a profile of the substantially rigid support member 200*a*, 200*b*. As illustrated in FIG. 5, a comfort layer 212 may have one or more lips 214 that extend upward of the profile of the substantially rigid support member 200*a*, 200*b*. The lips 214 may facilitate mating of the comfort layer 212 to the substantially rigid support member 200*a*, 200*b* through a lock-and-key mechanical fitting and/or can provide increased comfort to the user by shielding the edges of the substantially rigid support member 200*a*, 200*b*.

In an embodiment, a comfort layer 212 may have a variable or uniform thickness from gore to center and from center to side for increased comfort to the user. For example, the thickness of a comfort layer may range from about 1/16 inch to about ½ inch.

A thickness of a comfort layer 212 may be scaled to include any number of sizes to accommodate different sized breasts. The scaling system may be defined as one thickness of the comfort layer 212 scaled to the next largest or next smallest thickness. A comfort layer 212 may have a scaling system based on a percentage increase or decrease in thickness from the reference size, which can be any integer or non-integer between 0% and 50%. The scaling system may or may not occur equally throughout the entire comfort layer 212 and/or across the range of sizes.

In an embodiment, a comfort layer 212 may be formed from polymers such as silicone, thermoplastic elastomers (TPEs), thermoplastic polyurethane (TPU), and the like. A comfort layer 212 may include a foam, soft rubber, gel, a plastic, and/or other materials or a combination thereof. A comfort layer 212 have a Shore 00 hardness between about 20 Shore 00 and about 50 Shore 00. A comfort layer 212 may have a Shore A hardness between about 0 Shore A and about 40 Shore A.

According to various embodiments, a comfort layer 212 may have a colorant additive or may be used in its natural state. A comfort layer 212 may have a specific gravity between 0.8 to 1. A comfort layer 212 may have tensile strength between 1 MPa to 2 MPa.

In various embodiments, a hybrid support structure 242 as described in this disclosure may be incorporated into a variety of garments. A garment may be an undergarment such as, for example, various styles of bras including, without limitation, traditional bras, sports bras, strapless bras, and convertible bras. Other example garments may include swimsuits, lingerie, basques, bralettes, bustiers, corselets, corsets, tank tops, camisoles, other tops and/or the like. A garment having a hybrid support structure may include breast cups. A breast cup refers to a portion of a garment that encompasses, contains, supports or holds a wearer's breasts. Each substantially rigid support member may be positioned in a lower portion of a breast cup in order to provide support to the breasts from below. A substantially rigid support member may be positioned between a front portion and a back portion of a breast cup. In an embodiment, a substantially rigid support member may be molded into a breast cup.

In various embodiments, a garment may optionally include one or more straps. A garment, such as a strapless bra or strapless swimsuit for example, may include no straps. In an embodiment, a garment, such as a convertible bra, a halter bra, or a halter swimsuit for example, may include one strap. In other embodiments, a garment, such as a traditional bra, a swimsuit, or a top, may include two straps. Other garments, like a t-shirt, may include sleeves instead of straps.

Figure 8:
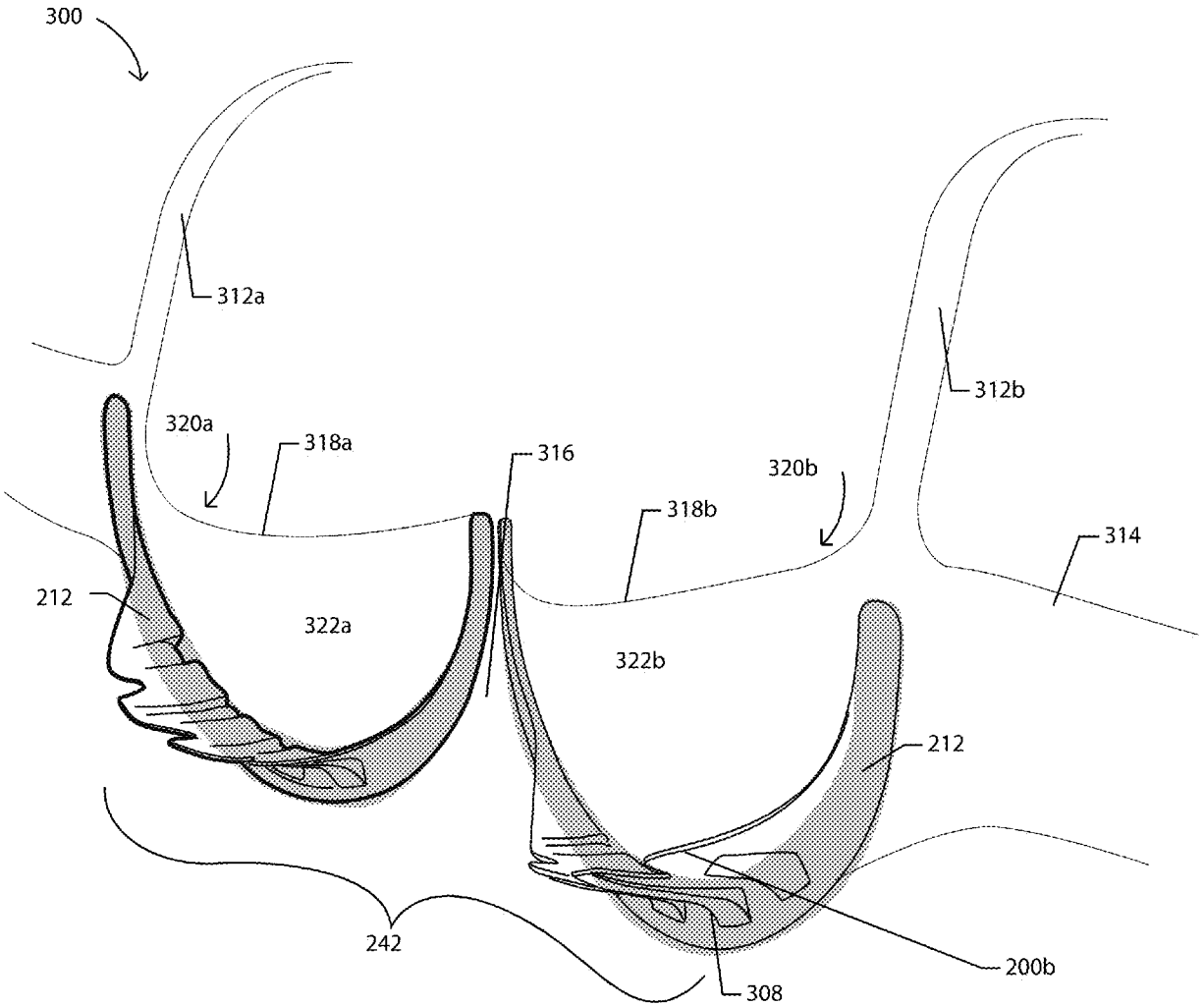
FIG. 8 illustrates an example bra having a hybrid support structure according to an embodiment.

FIG. 8 illustrates an example bra having a hybrid support structure according to an embodiment. As illustrated by FIG. 8, the bra 300 may include straps 312*a*, 312*b*, a band 314, and a gore 316. A hybrid support structure 242 for the bra 300 may include a substantially rigid support member 200*a*, 200*b* and a comfort layer 212 for each breast cup 318*a*, 318*b*. Each substantially rigid support member 200*a*, 200*b*, may be incorporated into a breast cup 318*a*, 318*b*. For instance, a substantially rigid support member 200*a*, 200*b* may be located in a lower portion of a breast cup 318*a*, 318*b* between an inner portion of the cup and an outer portion 322*a*, 322*b* of the breast cup. The inner portion and/or outer portion of a breast cup may be fabricated from fabrics, foam and/or other materials.

As shown in FIG. 8, a hybrid support structure 242 may include a gore 316. A gore 316 may be a connection between the substantially rigid support members 200*a*, 200*b* that follows tangent to the outer curvature of the breasts while keeping tangent to the horizontal curvature of the chest. A gore 316 may be made from the same material as the substantially rigid support members 200*a*, 200*b* and molded in the same piece or made from another material (e.g., a material with a different level of stiffness) and attached to the substantially rigid support members 200*a*, 200*b*. A gore 316 may be a resin-based material, composite, fabric, elastomer, and the like. In an embodiment, a gore 316 may press against the chest anywhere along the area of the sternum. A gore 316 may include stiffening ribs along either side of the horizontal direction of the structure between the curvatures of the breasts to allow for a level of stiffness that assists the substantially rigid support members 200*a*, 200*b* under the breasts to hold the load of the breasts in place.

A gore 316 may assist with supporting the moment load of the breasts and may also prevent the substantially rigid support members from being pulled away from the center of the chest when the band(s) 314 is tightened around a wearer's back. The structure of a gore 316 may still allow for the substantially rigid support member 200*a*, 200*b* to conform to the wearer's body by allowing the substantially rigid support members 200*a*, 200*b* to rotate about the vertical axis in line with the sternum where the gore contacts the chest. A gore 316 may be over molded or coupled with a secondary material with a lower hardness that may allow for both comfort against the body and provide a dampening effect to reduce the loads being felt on the body during dynamic loading events.

In an embodiment, substantially rigid support members 200*a*, 200*b* of a hybrid support structure 242 may not be directly connected. Rather, they may be incorporated into a garment as separate structures that are connected via a gore 316.

Figure 9:
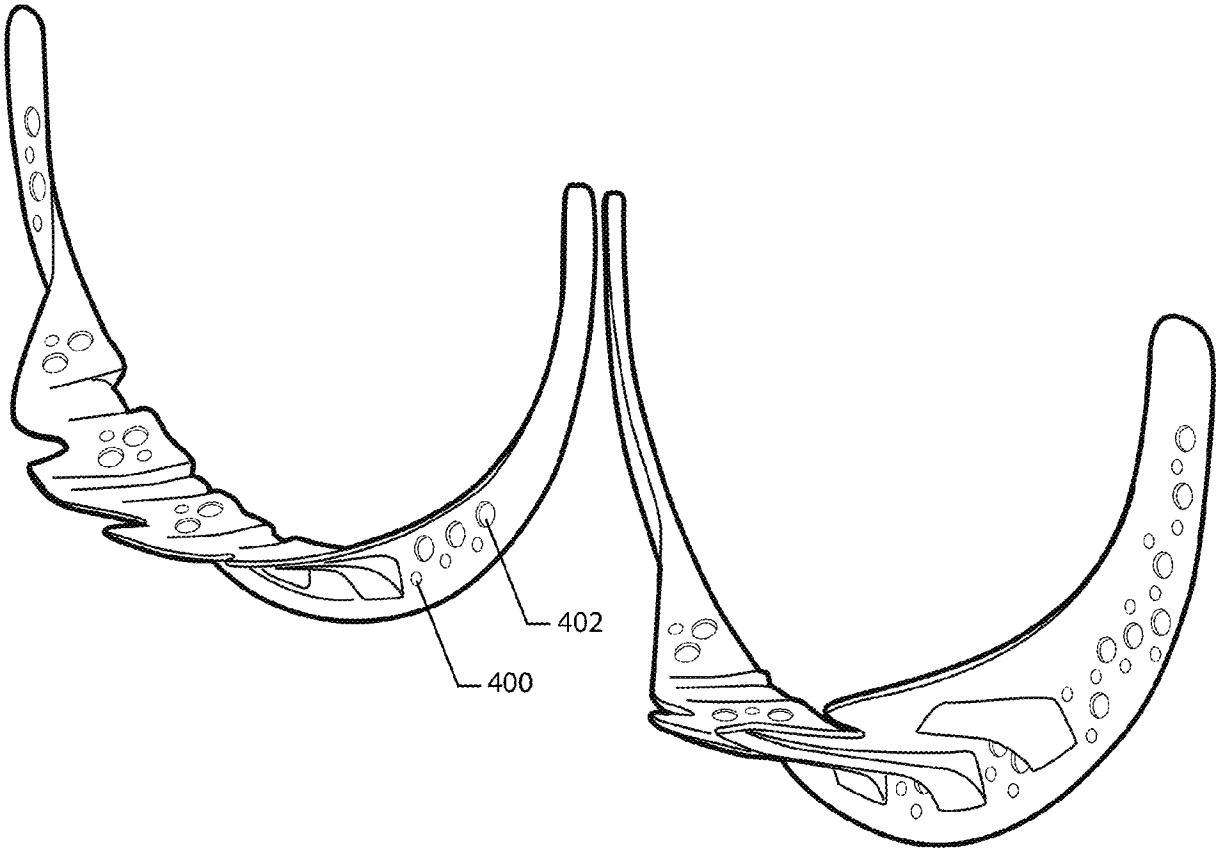
FIG. 9 illustrates an example hybrid support structure having perforations according to an embodiment.

As illustrated by FIG. 9, one or more substantially rigid support members 200*a*, 200*b*, any overmolded layers, and/or a comfort layer 212 may include one or more perforations 400, 402 throughout their thicknesses that may allow for some level of air flow from the body side of the structure to outside the structure according to various embodiments. The size of the perforations 400, 402 may vary depending on their location along the curvature of the breast or chest. The size of the perforations 400, 402 may vary between the different layers of the hybrid support structure even if they share the same location along the geometry of the breast or chest. In an embodiment, one or more of the perforations may optionally facilitate attachment of one or more fabric layers to the hybrid support structure and/or facilitate embroidery or other ornamental embellishments.

In various embodiments, spacing between structural elements of a substantially rigid support member may be sufficient to allow room for perforations 400, 402 of various diameters to allow for airflow from the inside of the hybrid support structure to the outside. The spacing between the structural elements may vary to allow for more support in desired areas or to allow for larger or smaller diameter perforations 400, 402 between the structural elements.

In an embodiment, larger perforations 402 may be utilized to facilitate airflow to the chest. In various embodiments, perforations, such as, smaller perforations 400 may facilitate coupling of a less rigid overmolded component to one or more substantially rigid support members 200*a*, 200*b*. For instance a portion of a bra cup may be overmolded over a substantially rigid support member 200*a*, 200*b* and coupled to the substantially rigid support member via one or more perforations. Although FIG. 9 illustrates two different sizes of perforations 400, 402, various other sizes and shapes of perforations may be used within the scope of this disclosure.

It will be appreciated that various of the above-disclosed and other features and functions, or alternatives thereof, may be desirably combined into many other different systems or applications or combinations of systems and applications. Also that various presently unforeseen or unanticipated alternatives, modifications, variations or improvements therein may be subsequently made by those skilled in the art which are also intended to be encompassed by the following embodiments.

What is claimed is:

1. A breast support structure of a garment, wherein the breast support structure comprises:
- one or more substantially rigid support members, wherein each substantially rigid support member comprises:
  - a profile portion having a first end, a second end and a generally curved body that extends between the first end and the second end, wherein the generally curved body comprises a top curved surface and a bottom curved surface,
  - a cantilevered portion connected to the top curved surface of the profile portion, wherein the cantilevered portion projects outward from the profile portion,
  - one or more structural elements extending across at least a part of the cantilevered portion and at least a part of the profile portion, and
  - one or more mechanical hinges, wherein one or more of the mechanical hinges comprises one or more grooves, wherein a first portion of the one or more grooves extends outward from the profile portion and across at least a portion of the cantilevered portion, wherein a second portion of the one or more grooves extends across at least a portion of the profile portion.

2. The breast support structure of claim 1, wherein the cantilevered portion is configured to extend under at least a portion of a wearer's breast.

3. The breast support structure of claim 1, wherein:
- the first end is configured to be positioned proximate a first side of a wearer's breast; and the second end is configured to be positioned proximate a second side of the wearer's breast.

4. The breast support structure of claim 1, wherein the cantilevered portion is formed integral with the profile portion.

5. The breast support structure of claim 1, wherein the one or more structural elements extend from an inner edge of the cantilevered portion toward an outer edge of the cantilevered portion.

6. The breast support structure of claim 1, wherein one or more of the mechanical hinges are positioned at an intersection of the cantilevered portion and the profile portion.

7. The breast support structure of claim 1, wherein one or more of the mechanical hinges comprises an aperture.

8. The breast support structure of claim 1, wherein the one or more substantially rigid support members each has a hardness value of between about 50 R to 130 R.

9. The breast support structure of claim 1, wherein the at least one substantially rigid support member is formed from one or more of the following:
- a polymer; and
- a polymer having one or more additives.

10. The breast support structure of claim 1, further comprising a comfort layer attached to an inner surface of the profile portion such that the comfort layer is configured to be positioned between a wearer and the one or more substantially rigid support members.

11. The breast support structure of claim 10, wherein the comfort layer is fabricated from one or more of the following:
- one or more polymers;
- a foam;
- a gel; and
- rubber.

12. The breast support structure of claim 10, wherein the comfort layer is overmolded over the one or more substantially rigid support members.

13. A garment for supporting a wearer's breasts, the garment comprising:
- a first breast cup comprising a first substantially rigid support member in a bottom portion of the first breast cup; and
- a second breast cup comprising a second substantially rigid support member in a bottom portion of the second breast cup;
- wherein the first substantially rigid support member, the second substantially rigid support member or both the first substantially rigid support member and the second substantially rigid support member comprise:
- a profile portion having a first end, a second end and a generally curved body that extends between the first end and the second end, wherein the generally curved body comprises a top curved surface and a bottom curved surface,
- a cantilevered portion connected to the top curved surface of the profile portion, wherein the cantilevered portion projects outward from the profile portion,
- one or more structural elements extending across at least a part of the cantilevered portion and at least a part of the profile portion, one or more mechanical hinges, wherein one or more of the mechanical hinges comprises one or more grooves, wherein a first portion of the one or more grooves extends outward from the profile portion across at least a portion of the cantilevered portion, wherein a second portion of the one or more grooves extends across at least a portion of the profile portion, and a comfort layer attached to an inner surface of the profile portion.

14. The garment of claim 13, wherein:

the first breast cup comprises a front portion and a back portion, wherein the first substantially rigid support member is positioned between the front portion of the first breast cup and the back portion of the first breast cup, the second breast cup comprises a front portion and a back portion, wherein the second substantially rigid support member is positioned between the front portion of the second breast cup and the back portion of the second breast cup.

15. The garment of claim 13, wherein:

the first breast cup is overmolded around the first substantially rigid support member, the second breast cup is overmolded around the second substantially rigid support member.

16. The garment of claim 13, wherein the garment comprises a brassiere.

17. The garment of claim 13, wherein the one or more mechanical hinges are positioned at an intersection of the cantilevered portion and the profile portion of the first substantially rigid support member, the second substantially rigid support member or both the first substantially rigid support member and the second substantially rigid support member.

18. The garment of claim 13, wherein one or more of the mechanical hinges comprises an aperture.

* * * * *